United States Patent [19]

Yamamoto et al.

[11] 4,071,356

[45] Jan. 31, 1978

[54] METHOD FOR REFINING A MOLTEN STEEL IN VACUUM

[75] Inventors: Satomi Yamamoto; Masataka Yoshii, both of Kitakyushu, Japan

[73] Assignee: Nippon Steel Corporation, Tokyo, Japan

[21] Appl. No.: 744,808

[22] Filed: Nov. 24, 1976

[51] Int. Cl.[2] ..... C21C 7/10; C21C 5/34

[52] U.S. Cl. ..... 75/59; 75/49; 75/60

[58] Field of Search ..... 75/49, 60, 59

[56] References Cited

U.S. PATENT DOCUMENTS

| | | | |
|---|---|---|---|
| 3,574,596 | 4/1971 | Lohman | 75/49 |
| 3,689,046 | 9/1972 | De Bie | 75/49 |
| 3,798,025 | 3/1974 | Ramachandran | 75/49 |
| 3,854,932 | 12/1974 | Bishop | 75/49 |
| 3,980,469 | 9/1976 | Förster | 75/49 |

*Primary Examiner*—Peter D. Rosenberg
*Attorney, Agent, or Firm*—Toren, McGeady and Stanger

[57] ABSTRACT

A method for refining a molten steel in vacuum, which comprises blowing a non-oxidizing gas or a non-oxidizing gas together with an oxidizing gas into a bath of the molten steel in a refining vessel of a R-H vacuum degassing apparatus at a position between the bath surface and a bath depth of 50 cm (inclusive) from the bath surface in an almost horizontal direction.

9 Claims, 7 Drawing Figures

In case of a single tuyere

In case of two tuyeres

METHOD FOR REFINING A MOLTEN STEEL IN VACUUM

BACKGROUND OF THE INVENTION

1. Field of the Invention

The present invention relates to a method and an apparatus for vacuum treatment such as decarburization degassing, removal of inclusions and bath temperature adjustment of various molten steels, more efficiently and economically than conventional arts using the R-H (Ruhrstahl-Heraeus) process.

Along with the increasing demands for higher grades of speciality steels, a more efficient and economical production process has been required. To meet with this requirement the refining of molten steels under vacuum has been an indispensable treatment method.

2. Description of Prior Arts

However, the convention vacuum degassing processes, such as the R-H process and the D-H (Dortmund-Hoerder) process, have the following problems to be still solved, which have been hindrances in their commercial operations.

i. The convention processes aim only at the degassing of molten steels and do not provide decarburization of the molten steels so that they can not prevent increase of carbon content in the molten steel and require use precious low-carbon or super-low carbon ferro-alloys;

ii. The conventional processes have no ability to increase the bath temperature during the treatment so that the lowering of the bath temperature during the treatment must be compensated for by increasing the blow-off temperature of a converter. This causes unavoidable wearing of the converter refractories.

In order to solve the above difficulties, it has been proposed to oxidize the molten steel bath under a reduced pressure and it has been known to blow pure oxygen onto a molten steel flowing in a vacuum refining vessel of R-H degassing apparatus from a tuyere provided above the molten steel bath. This method has solved the above problem (i) only and has been confronted with by the following unsolved problems.

1. As the gas is blown to the molten steel bath from a position above the bath surface, the molten steel splashes a great deal due to the shock caused by the blown gas.

2. There is insufficient contact between the bath and the gas so that efficiency of $O_2$ (for example, oxygen efficiency in respect to decarburization) is low.

3. As the gas is blown from above the bath, the slag, etc., if any, floating on the bath surface, hinders the contact between the gas and the molten steel, so that the efficiency of the $O_2$ is lowered.

4. The oxidation loss of alloying elements can not be eliminated completely. For example, in vacuum degassing of stainless steels, the chromium content is lost by 0.2 to 0.6% in any of the conventional processes, thus causing a production cost increase.

5. The finishing temperature can not be controlled precisely due to the oxidation loss of the alloying elements.

6. As the oxygen efficiency for decarburization varies widely in a low range from 40 to 70%, the final carbon content can not be controlled satisfactorily.

SUMMARY OF THE INVENTION

Therefore, one of the objects of the present invention is to provide a method and an apparatus for vacuum refining of molten steel which solves the problem of the bath oxidation confronted in the prior art.

The problem has been solved in the present invention by blowing a non-oxidizing gas either alone or together with an oxidizing gas directly into a molten steel bath under a reduced pressure.

The apparatus according to the present invention comprises a vacuum vessel in which a molten steel is circulated and a tuyere provided through the vacuum vessel at a position below the molten steel bath surface for blowing the gas directly into the molten steel bath.

In short, the present invention is based on the R-H process and relates to improvements of the R-H process in particular.

Hereinafter, the blowing of a non-oxidizing gas alone or together with an oxidizing gas is referred to simply as the gas blowing. Meanwhile, the oxidizing gas includes pure oxygen, $CO_2$ and water vapour, and the non-oxidizing gas includes argon and nitrogen.

DETAILED DESCRIPTION OF THE INVENTION

The present invention will be described in details referring to the attached drawings.

The present inventors considered the causes of the problems encountered with the conventional art device from the fact that the gas-liquid reaction interface to which an oxidizing gas, such as, $O_2$ blown from above the bath surface is limited, and for the purpose of increasing the gas-liquid reaction interface, the present inventors conducted decarburization experiments by lowering the gas blowing position. Thus a conventional tuyere of double-pipe structure was used for blowing $O_2$, and the position of the tuyere was lowered to a position which was immersed by the circulating flow of the molten steel in the refining vessel of the VAC type vacuum refining apparatus.

Using a conventional VAC apparatus (compressing a ladle having at its bottom a gas stirring device, and a vacuum tank in which the ladle is contained, and decarburization is done in vacuum using oxygen), the gas blowing position was varied within the range from 1.0 m above the bath surface to 1.5 m below the bath surface and the oxygen efficiency for decarburization and the lowering of the chromium content in case of 18% Cr stainless steel were compared. The oxygen was blown through the inner pipe and the argon was blown through the outer pipe. The results are shown in FIG. 1 and FIG. 2 from which it is clear that as the double-pipe tuyere approaches the bath surface, the oxygen efficiency for decarburization increases, and the oxidation loss of the chromium content is reduced.

Figure 1:
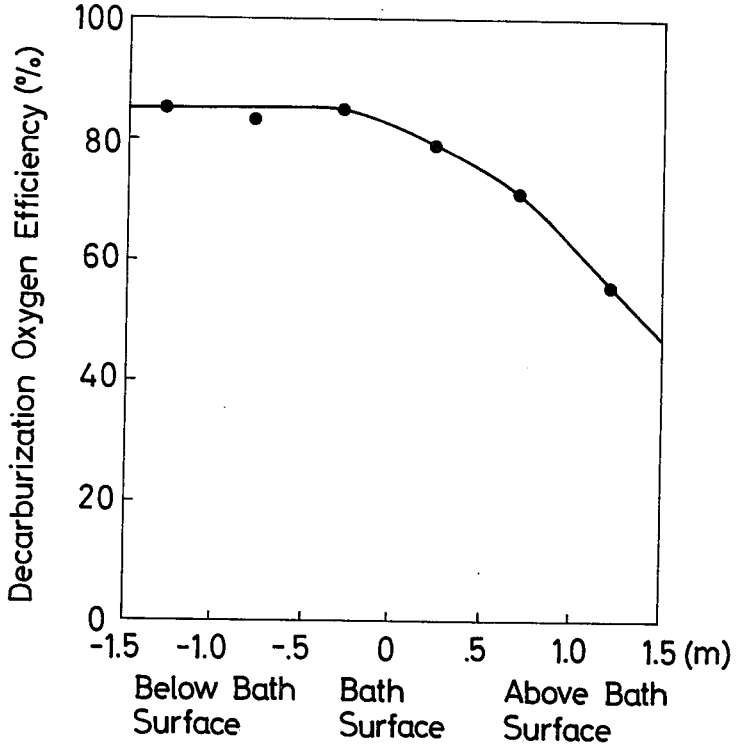
FIG. 1 is a graph showing the relation between the decarburization oxygen efficiency and the position of a tuyere for the gas blowing.
Figure 2:
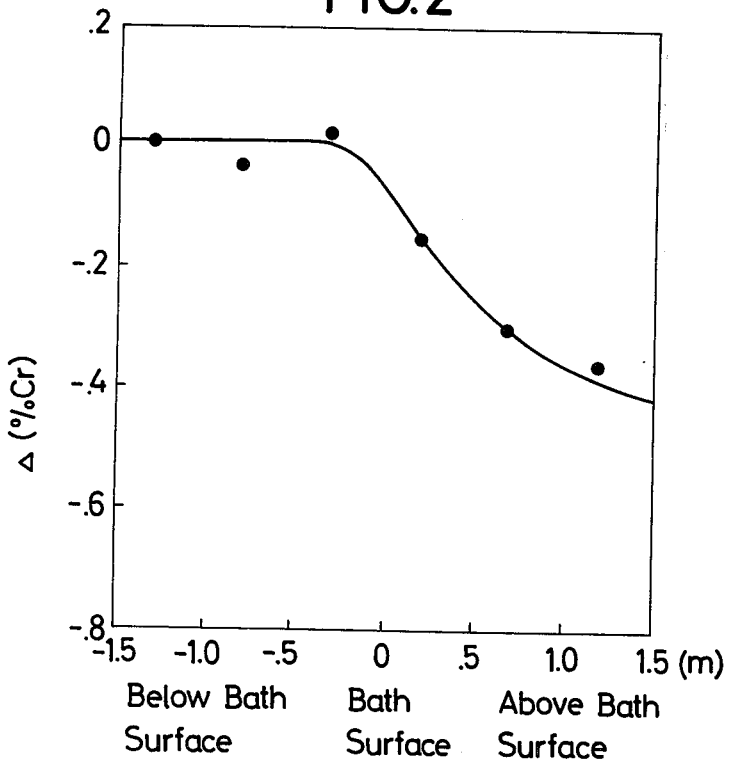
FIG. 2 is a graph showing the relation between the chromium loss and the position of a tuyere for the gas blowing.

In the graphs shown in FIG. 1 and FIG. 2; the decarburization oxygen efficiency $$= \frac{\text{Consumption of } O_2 \text{ by CO generation}}{\text{Amount of blown } O_2} \times 100(\%)$$

The pressure inside the vessel: 40 – 60 Torr. The tuyere was positioned below the bath surface and directed horizontally and in the same direction of the molten steel circulating flow. The gas blowing rate was 1000 $Nm^3/h$.

The above results are remarkable particularly when the gas is blown from below the bath surface, and the average decarburization oxygen efficiency increases to 85% as compared with 40% obtainable in the conventional VAC operation, and the lowering of the chromium content is zero as compared with the average lowering of 0.4% in the conventional VAC operation. In aspect of the position of the tuyere, the above results are obtained by positioning the tuyere below the bath surface level maintained with no gas blowing after degassing.

For the treatment of molten steel under a reduced pressure, it is conventionally known to use a top-blowing immersion lance. In this case, the operation is very unstable because of the peel-off and erosion of the lance refractory and the metal deposition on the lance which are caused by the mechanical vibration due to the gas blow foaming under the high temperature condition above 1600° C, and also it is very difficult to attain desirable decarburization rate at a high gas blowing rate.

According to the present invention, a tuyere of double-pipe structure, for example, is provided on the side wall of a vacuum refining vessel in order to assure security of the refractories surrounding the tuyere and the defects of the conventional immersion lance are eliminated.

The desired results of the present invention are attained by blowing the gas at a position shallow below the bath surface contacting the evacuated atmosphere in the refining vessel. This feature is advantageous in the following point.

In the conventional R-H vacuum degassing apparatus, in which a part of the molten steel is introduced into the vacuum vessel and circulated for degassing, the bath depth of the molten steel contained in the evacuated vessel is limited. The present invention can perform both the gas blowing and the decarburization in the R-H type apparatus.

As for the most preferable embodiment of the apparatus of the present invention, a R-H type vacuum refining apparatus may be used for the following reason.

1. In this type of apparatus, the bath is automatically circulated by the vacuum effect (pressure difference) and a fresh bath surface contacts with the vacuum atmosphere. Thus this type is ideal for the refining.

2. It is not desirable to move the refining vessel because it is provided with a gas supply pipe for the gas blowing.

Further, additional results as set forth below can be obtained according to the present invention.

When as non-oxidizing gas is blown in the same direction as the bath circulation in the vacuum refining vessel, the amount of molten steel circulation (T/min.) as attained in the R-H process is increased by the pumping-up action of the molten steel by the blown gas, so that the total amount of molten steel which is exposed to the evacuated atmosphere within a given time increases. Thereby the gas blowing rate ($Nm^3/h$) can be increased so that the treating time is remarkably shortened.

From the results shown in FIG. 1 and FIG. 2, it is understood that the desired results can be obtained if the tuyere is positioned below the bath surface. However, in order to avoid the danger that the tuyere is exposed above the bath surface due to the change of the bath surface level caused by changes in the vacuum degree or by wear of the refractories and the thus exposed tuyere causes the wear of the refractories of the opposite wall, and also in order to avoid the increased temperature of the refractories by oxidation of the metal depositing on the vacuum vessel, it is desirable to position the tuyere about 20 cm or more below the bath surface.

In the R-H degassing apparatus, it is theoretically possible to maintain the depth of the circulating molten steel flow at 50 cm or more, but in order to avoid attack of the refractories of the vessel bottom by the blown gas, it is required to position the tuyere not larger than 50 cm below the bath surface.

According to the findings by the present inventors, the most preferable range is from 20 to 40 cm below the bath surface.

The gas blown in a horizontal direction below the bath surface maintains a large gas-liquid interface as mentioned before, and is retained in the bath for a long time so that the reaction efficiency is considerably improved. Thus the ratio of oxygen ($O_2$) used for the decarburization, namely the decarburization oxygen efficiency is stable and high.

When the gas is blown slantingly excessively upward from the horizontal direction, the reaction time with the bath is shorter and the blowing is done without desirable reaction, thus lowering the efficiency of the gas and also causing loss of the molten steel.

On the other hand, when the gas is blown slantingly excessively downward from the horizontal direction, the gas is blown against the bottom of the vacuum vessel, causing damage of the refractories.

For the practice of the present invention novel technical considerations as set below are required.

If the operation is done under the same level of vacuum (usually 80 Torr or less) as in the conventional top-blown process, more severe spitting is caused and in the extreme case the alloy addition opening is clogged and the metal deposits on the vacuum system to cause lowering of gas exhausting ability, thus remarkably hindering the operation.

According to the present invention, it is possible to prevent substantially completely the metal deposition on the vessel while maintaining the advantages of the reactions in the vessel as obtained conventionally and remarkably shortening the decarburization time by increasing the gas blowing rate.

Figure 3:
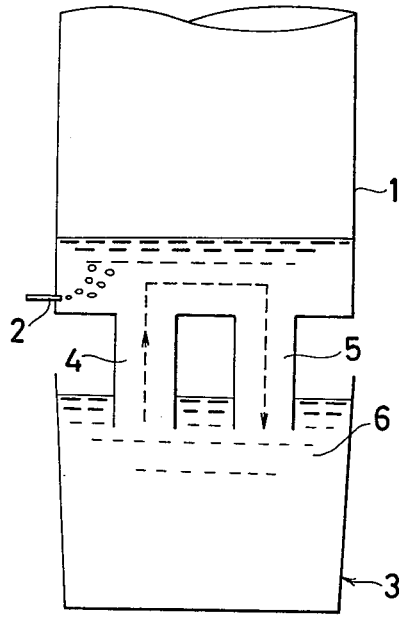
FIG. 3 shows schematically a degassing apparatus used in the present invention.

Decarburization tests were made on 18% Cr stainless molten steel with different $O_2/Ar$ ratios and vacuum degrees using the apparatus as shown in FIG. 3 in which a double-pipe tuyere 2 is provided through the side wall of the vacuum vessel 1 at a depth of 30 cm below the bath surface, and 3 represents a ladle, 4 represents an upward pipe, 5 represents a downward pipe and 6 represents the molten steel. In the tests, the argon was blown through the outer pipe and the oxygen or the oxygen-argon mixture was blown through the inner pipe in a horizontal direction and in the same direction as the circulating flow of the molten steel.

Figure 4:
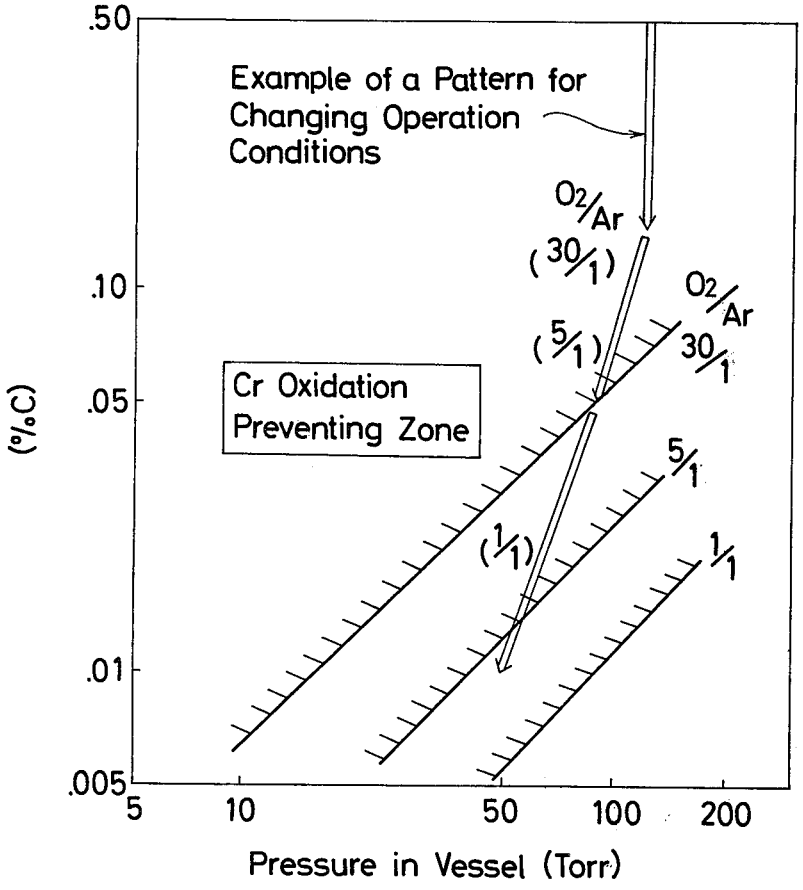
FIG. 4 is a graph showing the decarburization zone without the oxidation loss of chromium.
Figure 5:
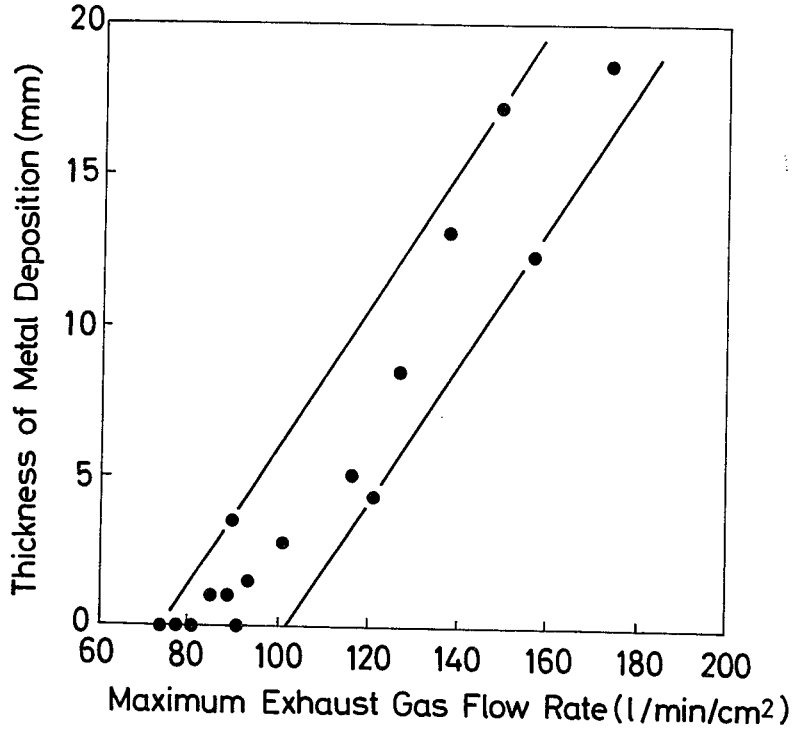
FIG. 5 is a graph showing the relation between the metal deposition on the uppermost portion of the vacuum vessel and the maximum exhaust gas flow rate generated from the steel bath surface.

The ratio of $O_2$/Ar (by volume) was maintained within the range from 30/1 to 1/1, and the vacuum degree in the vessel was maintained in the range from 200 to 20 Torr during the decarburization by the ejector operation. The results of the tests revealed that as the $O_2$/Ar ratio decreases, and as the vacuum degree increases, the decarburization can be attained to a lower carbon content without the lowering of the chromium content. Based on the results of the tests, the condition for decarburization without the loss of the chromium content could be found in respect to the carbon content, the $O_2$/Ar ratio and the vacuum degrees as shown by the slant-lined zone shown in FIG. 4 (16 – 17% Cr stainless steels). At the same time the thickness of the metal deposit on the metal fittings attached at the upper most portion (5 m above the bath surface) of the vacuum vessel was measured, and it was revealed from the measurements that the thickness increases in proportion as the maximum flow rate of the exhaust gas generating from the bath surface increase as shown in FIG. 5.

The exhaust gas flow rate is determined by the gas blowing rate, the vacuum degree, the decarburization oxygen efficiency, the bath temperature, etc. As for the condition for preventing the metal deposition the following formula is obtained.

$$(2\eta V_{O_2} + V_{Ar}) \cdot \frac{T + 273}{273} \cdot \frac{760}{P} \cdot \frac{1}{S} \lesssim 100(\mathrm{l/min/cm^2}) \qquad (1)$$

in which:

$\eta$ : decarburization oxygen efficiency $V_{O_2}$ : $O_2$ gas blowing rate ($l$/min)

$V_{AR}$ : AR gas blowing rate ($l$/min)

$S$ : surfacial dimension of the bath in the vacuum vessel (cm$^2$)

$T$ : molten steel temperature (° C)

$P$ : pressure in the vessel (Torr)

Preferably, the right side item 100 ($l$/min/cm$^2$) is set to 80 ($l$/min/cm$^2$). In order to prevent the metal deposition under various $O_2$/Ar ratios, it is found necessary to consider the oxygen blowing rate and the pressure in the vessel.

Therefore, on the basis on the above relation, the metal deposition can be prevented by increasing the pressure in the vessel even when the oxygen blowing rate is increased considerably.

In case of decarburization of ordinary steels, low-alloy steels and silicon steels, for example, other than the high alloy steels such as stainless steels, it is not necessary to change the ratio between the non-oxidizing and the oxidizing gas, and it is enough only to control the gas blowing rate.

For controlling and adjusting the ratio between the non-oxidizing gas and the oxidizing gas, it is necessary to use a tuyere of double-pipe structure as used in AOD process.

The maximum gas blowing rate per one tuyere is about 1500 Nm$^3$/h, and a preferable range is from 1200 to 500 Nm$^3$/h from the following reasons.

1. The gas blown does not contact with the opposite side wall of the vacuum refining vessel.

2. When a tuyere of large diameter is used for blowing a large amount of gas, the refractories surrounding the tuyere are damaged if the operation is done with a low gas blowing rate.

On the other hand, the minimum gas flow rate is determined from the fact that when the gas amount blown from the tuyere is small, it is pushed back, by the static pressure of the molten steel and gives shock and damage to the refractories surrounding the tuyere. Therefore, at least 200 Nm$^3$/h of the gas blow rate is necessary.

When there are present in the molten steel bath elements such as Al and Si, which generate heat by oxidation, it is possible to increase the bath temperature by causing such elements to react with the oxidizing gas with an average heat generation efficiency of about 73%.

The apparatus of the present invention will be described in reference to FIG. 3.

In order to blowing the gas consistently, the tuyere should be protected by cooling and for this purpose, a tuyere of double-pipe structure which can be cooled by the non-oxidizing gas blown through the outer pipe is desirable.

The position of the tuyere is determined from the following considerations.

1. The bath depth

The opening end of the tuyere provided on the inside wall of the vacuum vessel should be 50 cm from the bath surface for the reason set forth hereinbefore. This position should be maintained irrespective to the number of the tuyere.

2. The molten steel flow in the vacuum refining vessel

Regarding the relation between the gas blowing direction and the flowing direction of the molten steel in the vacuum tank, it is desirable that the gas blow and the molten steel flow are maintained in the same direction for the purpose of increasing the circulation of the molten steel and thus improving the reaction efficiency. When a plurality of tuyeres are provided for increasing the gas flow, it is desirable that the tuyeres are provided in such a manner that the crossing point of their blowing direction is above the downward pipe, and that they are spaced from each other with a center angle ($\theta$) between 5° and 15° on the basis of the center of the downward-pipe, or they are spaced from each other 20 to 70 cm measured between their opening ends. The above numerical limitations are determined from the following considerations.

The gas blown into the molten steel bath spreads with an angle of about 20°. Therefore, in order to avoid interference among the foams immediately after the blowing and to attain desirable foam distribution, the above center angle range for the tuyeres is essential.

The above defined distance between the opening ends of the tuyeres is calculated from the center angle in view of a diameter of the vacuum refining vessel, and its minimum distance is determined from a physical space required for the tuyere arrangement.

Figure 6:
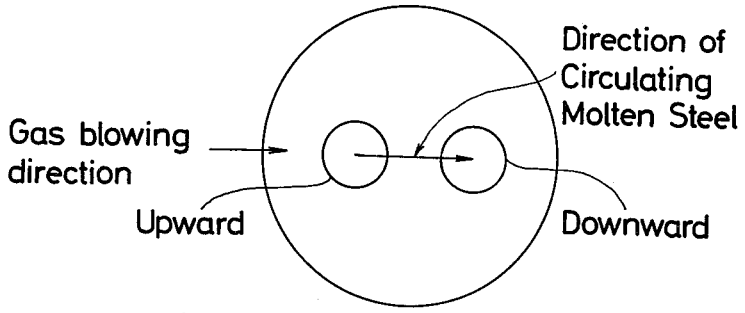
FIG. 6 shows schematically the gas blowing directions.
Figure 6:
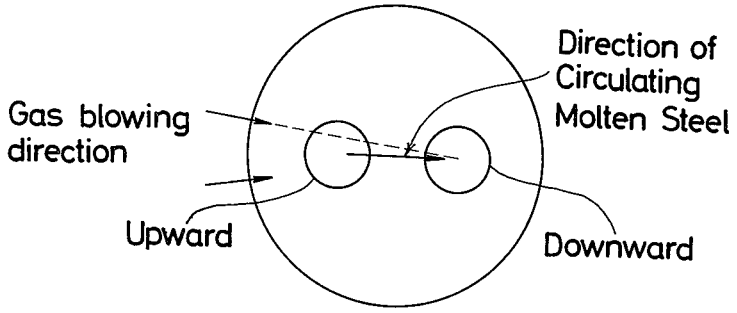

The arrangement of one or plural tuyeres are shown in FIG. 6.

It should be understood that the present invention is not limited to the above arrangements of the tuyeres which are illustrated as a preferable embodiments, and various modifications can be made within the scope of the present invention.

3. The direction of the bath surface

It is desirable that the gas blowing direction is horizontal from the reasons set forth below, although there is no practical hinderance if the blowing is deviated with an angle of ±5° from the horizontal line.

i. When the blowing is diviated below from the horizontal direction there is some possibility that the gas contacts with the bottom of the vacuum tank. This is not desirable for protection of the refractories.

ii. When the gas blowing is deviated above the horizontal line, there is possible that the oxidizing gas is blown without reaction effect, so that the efficiency of $O_2$ lowers.

Table 1

| [% C] | Gas blowing rate ($Nm^3/h$) | $O_2/Ar$ (by volume) | Vacuum degree in vacuum vessel |
|---|---|---|---|
| Initial C% | | | Torr |
| -0.15 | 800-1200 | 10-30 | 100-150 |
| 0.15-0.05 | 700-1100 | - 5 | 100-150 |
| 0.05-0.01 | 200-400 | - 1 | 50-80 |

Table 2

| | Composition before Decarburization (%) | | | | Composition after Decarburization (%) | | | | Decarburization | Yield of Molten | | Maximum Exhaust Gas |
|---|---|---|---|---|---|---|---|---|---|---|---|---|
| | C | Si | Mn | Cr | C | Si | Mn | Cr | Time | Steel | Δ[%Cr] | Volume |
| Present | 0.50 | 0.05 | 0.20 | 16.30 | 0.041 | 0.05 | 0.15 | 16.35 | min | % | % | $l/min/cm^2$ |
| Inventive | | | | | | | | | 25 | 99.2 | 0.05 | 75 |
| Method | 0.45 | 0.03 | 0.22 | 16.81 | 0.045 | 0.04 | 0.20 | 16.80 | 21 | 99.4 | −0.01 | 70 |
| | 0.59 | 0.04 | 0.18 | 16.55 | 0.045 | 0.05 | 0.14 | 16.65 | 26 | 99.3 | 0.10 | 80 |
| Conventional | 0.40 | 0.02 | 0.15 | 16.10 | 0.030 | 0.02 | 0.08 | 15.70 | 40 | 85.2 | −0.30 | 90 |
| | ~ | ~ | ~ | ~ | ~ | ~ | ~ | ~ | ~ | ~ | ~ | ~ |
| Method (Top-blown) | 0.60 | 0.09 | 0.25 | 17.30 | 0.090 | 0.07 | 0.17 | 16.90 | 55 | 85.9 | −0.75 | 120 |

DESCRIPTION OF PREFERRED EMBODIMENTS

The present invention will be more clearly understood from the following embodiments.

The present invention is not limited to any specific steel and useful for decarburization and degassing of ordinary steels, silicon steels and speciality steels, but the description will be made in connection with the decarburization of chromium-containing steels for which the present invention is most useful.

Equipment

Vacuum refining vessel inside diameter: 1.6 m (capable to treat 60 ton of molten steel by one charge)

Arrangement of tuyere: the tuyere is arranged in such a manner that the gas is blown in a horizontal direction and in the same direction as the circulating flow of the molten steel in the vacuum vessel.

Structure of tuyere: Double-pipe structure; the inner pipe is used for blowing at least one of oxidizing gas and non-oxidizing gas, and the outer pipe is used for blowing only non-oxidizing gas through the space between the inner pipe and the outer pipe.

Figure 7:
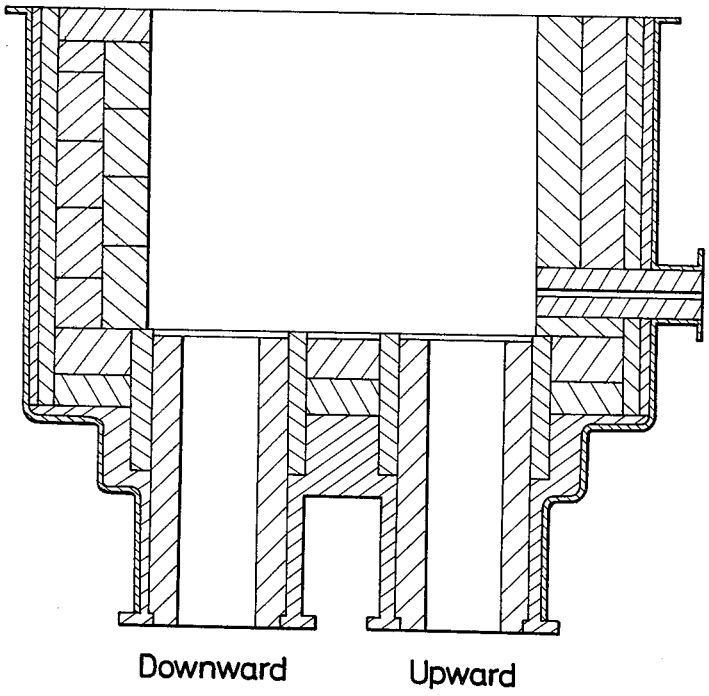
FIG. 7 shows schematically the tuyere incorporated in the vacuum refining vessel.

The equipment as above specified is shown in FIG. 7.

The results of decarburization using the above apparatus are shown in Table 2 in comparison with those obtained by the conventional top-blown process.

The operation conditions were changed step-wisely in correspondence to the carbon content in the bath as shown in Table 1 from the initial conditions set forth above.

The results of the conventional top-blown operation were obtained under the ordinary conditions; the gas blowing rate of 600 - 800 $Nm^3/h$ and the vacuum degree of 60 to 30 Torr.

As clearly understood from the results shown in Table 2, the present invention has the following technical advantages over the conventional top-blown decarburization process.

1. The loss of alloying elements by oxidation is remarkably lowered. Particularly in decarburization of stainless steels, the oxidation of chromium is completely prevented.

2. It is possible to increase the gas blowing rate remarkably, thus shortening the decarburization time.

3. It is possible to prevent almost completely the metal deposition on the inside of the vacuum refining vessel due to spitting. This assures great advantage in respect of the equipment security, the operation and the production yield.

4. Control of the final carbon content and the final bath temperature is remarkably improved.

Although not shown in Table 2, the following advantages are attained by the present invention.

5. It is possible to treat matters steel compositions containing 100 ppm or less of carbon.

6. Contents of H, N and O in the molten steel after the refining are similar to or lower than those obtained by the conventional top-blown process.

7. It is possible to utilize about 73% of the oxidation heat of elements such as C, Al, Si contained in the bath for increasing the bath temperature.

What is claimed is:

1. In a method for refining molten steel in a vacuum using a R-H vacuum degassing apparatus by blowing a gas through a tuyere into the molten steel bath, the improvement which comprises blowing the gas into the bath at a position between the bath surface and a depth of 50 cm from the bath surface in a substantially horizontal direction.

2. A method according to claim 1, in which the gas is blown into the molten steel bath from a single blowing point at a blowing rate not lower than 200 $Nm^3/h$.

3. A method according to claim 1, in which the gas is blown into the molten steel bath from a single blowing point at a blowing rate not higher than 1500 $Nm^3/h$.

4. The method of claim 1 wherein the gas is a non-oxidizing gas.

5. The method of claim 1 wherein the gas is a mixture of a non-oxidizing gas and an oxidizing gas.

6. A method according to claim 5, in which at least one of the pressure of the atmosphere contacting the molten steel bath, the amount of the non-oxidizing gas and the amount of the oxidizing gas is adjusted so as to maintain a volume of exhaust gas generating from the molten steel of not higher than 100 $l$/min/cm$^2$ of the cross section of the bath.

7. A method according to claim 5, in which the pressure of the atmosphere contacting the molten steel is maintained at a higher level at an initial stage of the refining than at a subsequent stage of the refining to initiate the refining with a large amount of the gas blow, and during the progress of the refining, at least one of the amount of the gas blow, the pressure of the atmosphere contacting the molten steel, and the proportional ratio of the non-oxidizing gas to the oxidizing gas is lowered.

8. The method of claim 7 wherein the lowering is carried out continuously.

9. The method of claim 7 wherein the lowering is carried out step-wise.

* * * * *